US009385422B2

(12) United States Patent
Vortmeier et al.

(10) Patent No.: US 9,385,422 B2
(45) Date of Patent: Jul. 5, 2016

(54) ANTENNA BANDWIDTH-OPTIMIZED BY HYBRID STRUCTURE COMPRISING PLANAR AND LINEAR EMITTERS

(75) Inventors: Gunther Vortmeier, Aichtal (DE); Christoph Degen, Krefeld (DE); Stefan Droste, Herzogenrath (DE)

(73) Assignee: Saint-Gobain Glass France, Courbevoie (FR)

( * ) Notice: Subject to any disclaimer, the term of this patent is extended or adjusted under 35 U.S.C. 154(b) by 815 days.

(21) Appl. No.: 13/581,588

(22) PCT Filed: May 18, 2011

(86) PCT No.: PCT/EP2011/058091

§ 371 (c)(1),
(2), (4) Date: Jan. 4, 2013

(87) PCT Pub. No.: WO2011/144680

PCT Pub. Date: Nov. 24, 2011

(65) Prior Publication Data

US 2013/0099981 A1 Apr. 25, 2013

(30) Foreign Application Priority Data

May 19, 2010 (EP) ..... 10163201

(51) Int. Cl.
*H01Q 1/38* (2006.01)
*H01P 11/00* (2006.01)
(Continued)

(52) U.S. Cl.
CPC ..... *H01Q 1/38* (2013.01); *H01P 11/00* (2013.01); *H01Q 1/1271* (2013.01); *H01Q 1/32* (2013.01);
(Continued)

(58) Field of Classification Search
CPC ..... H01Q 1/38; H01P 11/00
USPC ..... 343/700 MS; 29/600
See application file for complete search history.

(56) References Cited

U.S. PATENT DOCUMENTS 4,736,206 A 4/1988 Sakurai et al.
4,746,925 A * 5/1988 Toriyama ..... H01Q 1/1271 343/700 MS
(Continued)

FOREIGN PATENT DOCUMENTS

EP 0 418 047 3/1991
EP 1 858 114 11/2007

OTHER PUBLICATIONS

International Preliminary Report on Patentability Issued Nov. 20, 2012 in PCT/EP11/058091 Filed May 18, 2011 (with English translation).
(Continued)

*Primary Examiner* — Graham Smith
*Assistant Examiner* — Andrea Lindgren Baltzell
(74) *Attorney, Agent, or Firm* — Oblon, McClelland, Maier & Neustadt, L.L.P.

(57) ABSTRACT

The invention relates to a hybrid antenna structure that comprises at least one electrically insulating substrate, at least one electrically conductive coating that covers at least one surface of the substrate at least section-wise and serves as a planar antenna for reception of electromagnetic waves, as well as at least one coupling electrode electrically coupled to the conductive coating for coupling out of antenna signals from the planar antenna. It is essential here that the coupling electrode be electrically coupled to an unshielded, linear antenna conductor that serves as a linear antenna for reception of electromagnetic waves, with the antenna conductor situated outside an area that can be projected by orthogonal parallel projection onto the planar antenna serving as a projection area, by which means an antenna foot point of the linear antenna becomes a common antenna foot point of the linear and planar antenna. The invention further relates to a method for producing such a hybrid antenna structure.

17 Claims, 14 Drawing Sheets

(51) Int. Cl.

| | |
|---|---|
| ***H01Q 1/12*** | (2006.01) |
| ***H01Q 1/32*** | (2006.01) |
| ***H01Q 9/40*** | (2006.01) |
| ***H01Q 9/42*** | (2006.01) |
| ***H01Q 21/30*** | (2006.01) |

(52) U.S. Cl.
CPC . *H01Q 9/40* (2013.01); *H01Q 9/42* (2013.01); *H01Q 21/30* (2013.01); *Y10T 29/49016* (2015.01)

(56) References Cited

U.S. PATENT DOCUMENTS

| | | | | |
|---|---|---|---|---|
| 4,768,037 | A | 8/1988 | Inaba et al. | |
| 5,119,106 | A | 6/1992 | Murakami | |
| 5,128,685 | A | 7/1992 | Shinnai et al. | |
| 5,285,048 | A * | 2/1994 | Nakase | H01Q 1/1278 219/203 |
| 6,292,150 | B1 * | 9/2001 | Doi | H01Q 1/1271 343/713 |
| 2007/0257850 | A1 | 11/2007 | Onaka et al. | |
| 2007/0296592 | A1 * | 12/2007 | Huang | G02F 1/1303 340/572.7 |

OTHER PUBLICATIONS

U.S. Appl. No. 13/581,754, filed Aug. 29, 2012, Vortmeier, et al.
International Search Report Issued Jul. 6, 2011 in PCT/EP11/058091 Filed May 18, 2011.

* cited by examiner

A-A

A-A

B-B

A-A

B-B

A-A

B-B

B-B

A-A

A-A

ANTENNA BANDWIDTH-OPTIMIZED BY HYBRID STRUCTURE COMPRISING PLANAR AND LINEAR EMITTERS

The invention relates to a hybrid antenna structure comprising planar and linear emitters, as well as a method for production thereof.

Substrates with electrically conductive coatings have already been described frequently in the patent literature. Merely by way of example, reference is made in this regard to the publications DE 19858227 C1, DE 10200705286, DE 102008018147 A1, and DE 102008029986 A1. As a general rule, the conductive coating serves for reflection of heat rays and thus provides for an improvement of thermal comfort, for example, in motor vehicles or in buildings. Frequently, it is also used as a heating layer to heat the entire surface of a transparent pane.

As is known, for example, from the publications DE 10106125 A1, DE 10319606 A1, EP 0720249 A2, US 2003/0112190 A1, and DE 19843338 C2, because of their electrical conductivity, transparent coatings can also be used as planar antennas for reception of electromagnetic waves. For this purpose, the conductive coating is galvanically or capacitively coupled to a coupling electrode and the antenna signal is made available in the edge region of the pane. Via a connector conductor, typically with interconnection of an antenna amplifier, the antenna signals are fed to a receiver. Customarily used as connector conductors are unshielded stranded wires or foil conductors, which do, in fact, have a relatively low ohmic resistance and cause only slight ohmic power losses, but permit no defined signal transmission because, due to inevitable positional tolerances, undefined couplings with the electrically conductive motor vehicle body or nearby conductors can occur such that the range of fluctuation of important antenna properties such as bandwidth, efficiency, and foot point impedance is relatively great. For this reason, such unshielded conductors must be kept relatively short.

Signal losses can be avoided through the use of special high-frequency conductors, which have, in addition to a signal conductor, at least one ground wire along with them (coaxial conductors, coplanar conductors, microstrip conductors, etc.). However, such high-frequency conductors are complex and cost intensive and need relatively large installation space. Moreover, they require equally complex connection methods. In motor vehicles, the antenna amplifier is electrically connected to the electrically conductive motor vehicle body, with a reference potential (ground) effective for high-frequency applications predetermined for the antenna signal by this electrical connection. The difference between the reference potential and the potential of the antenna signal yields the available antenna power.

The conductive coating serving as a plane-shaped antenna or planar antenna for reception of electromagnetic waves is also referred to, here and in the following, as a "planar emitter" because of the fact that it can also be used to transmit electromagnetic waves. By way of differentiation from planar emitters, line-shaped antennas or linear antennas for reception of electromagnetic waves, referred to, here and in the following, as "linear emitters", have a geometric length (L) that exceeds their geometric width (B) by multiple orders of magnitude. The geometric length of a linear emitter is the distance between the antenna foot point and the antenna tip; the geometric width, the dimension perpendicular thereto. As a rule, for linear emitters, the following relationship applies: $L/B \geq 100$. Similarly, in the case of linear antennas, the following applies to their geometric height (H), meaning a dimension that is both perpendicular to the length (L) and also perpendicular to the width (B), where, as a rule, the following relationship applies: $L/H \geq 100$.

The antennas built into conventional windshields (not equipped with a conductive coating) are of the linear emitter type since they can be used in windshields of motor vehicles provided they do not impair the driver's vision. This can, for example, be achieved by means of fine wires with a diameter of, typically, 10 to 150 μm.

A satisfactory antenna signal can be provided by linear emitters in the range of the terrestrial broadcast bands II through V. According to a definition of the International Telecommunication Union (ITU), this is the frequency range from 87.5 MHz to 960 MHz (band II: 87.5-100 MHz, band III: 162-230 MHz, band IV: 470-582 MHz, band V: 582-960 MHz). However, satisfactory reception performance cannot be obtained in the preceding frequency range of band I (41-68 MHz). The same is also true for frequencies below band I.

When such a conventional configuration consisting of a windshield and a linear emitter is also equipped with an electrically conductive layer, in other words, when an electrically conductive layer is added to a linear emitter, the linear emitter loses its broadband properties. This is primarily attributable to the near-field coupling between planar and linear emitter and a linear-emitter-shielding action of the conductive layer, which has a negative effect on the reception performance of the linear emitter, in particular with an increasing frequency. Even a wide variation of the electrical length of the linear emitter does not result in the desired reception properties of a broadband antenna satisfactorily covering at least the frequency range of bands II-V.

On the other hand, by means of the planar emitter, a particularly good reception performance in the frequency range of band I and a reception performance comparable to the linear emitter in the frequency range of band II can be obtained. However, the reception performance of the planar emitter deteriorates at higher frequencies due to the relatively high electrical sheet resistance of the conductive coating. In motor vehicles, a further cause is a strong capacitive coupling between the conductive coating and the electrically conductive motor vehicle body. This problem can be prevented by a coating-free edge zone, which must, however, not be arbitrarily wide since the transition into the edge zone is to be concealed by an opaque edge strip for a visually acceptable result. On the other hand, the other functions of the conductive coating, such as its heat-ray reflecting property, deteriorate with widening of the edge zone. Consequently, in practice, the edge zones typically have a width of 10 mm or less.

Improved reception performance can be obtained with the antenna pane disclosed in the unpublished international patent application PCT/EP2009/066237, wherein, by means of segmentation of the electrically conductive coating, an increase in the distance between the conductive coating and the electrically conductive motor vehicle body is accomplished effectively for high-frequency applications.

It would also be conceivable to improve the reception performance of the planar emitter by reducing the electrical sheet resistance. This requires an increase in the layer thickness of the conductive coating, which is, however, always accompanied by a reduction in optical transmission and, regardless of practicability, is possible only to a limited extent because of regulatory requirements.

As is known to the person skilled in the art, it is also possible to influence the reception performance of the planar emitter by the positioning of the antenna foot point on which the high-frequency signal is picked up. However, in practice, this approach results in problems because an antenna foot point optimized in this manner is often quite far from the downstream electronics (e.g., antenna amplifier). Since the spatial positioning usually cannot be changed because of the installation space available and the special requirements with regard to safety and cost effectiveness, it is necessary in some cases to bridge a large spatial distance. Thus, a relatively long signal transmission path between the antenna foot point and downstream electronics works against improved reception performance. To avoid signal losses and in the interest of reproducibility, it is thus often necessary to use special high-frequency conductors, whose disadvantages have already been described above.

In contrast, the object of the present invention consists in further improving a conventional antenna structure such that electromagnetic signals can be received over the complete reception range of the terrestrial broadcasting bands I-V with satisfactory reception performance. This and other objects are accomplished according to the proposal of the invention by means of a hybrid antenna structure with the characteristics of the independent claim. Advantageous embodiments of the invention are set forth through the characteristics of the dependent claims.

The hybrid antenna structure of the present invention comprises at least one electrically insulating, preferably transparent substrate, as well as at least one electrically conductive, preferably transparent coating that covers at least one surface of the substrate at least section-wise (at least a section thereof) and serves at least section-wise (in at least a section thereof) as a plane-shaped antenna (planar antenna or planar emitter) for reception of electromagnetic waves. The conductive coating is suitably configured for use as a planar antenna and can, for this purpose, largely cover the surface of the substrate. The antenna structure further comprises at least one coupling electrode electrically coupled to the conductive coating for coupling out (extracting) of antenna signals from the planar antenna. The coupling electrode can, for example, be coupled capacitively or galvanically to the conductive coating.

According to the proposal of the invention, the coupling electrode is electrically coupled to an unshielded, linear conductor, hereinafter referred to as "antenna conductor". The antenna conductor serves as a linear antenna for reception of electromagnetic waves and is suitably configured for this purpose, in other words, it has a form suitable for reception in the desired frequency range. As a linear antenna or linear emitter, the antenna conductor fulfills the conditions mentioned in the introduction with regard to its dimension in the extension direction (length L) and the two dimensions perpendicular thereto (width B, height H). The antenna conductor can, for example, be implemented in wire form or as a flat conductor. The coupling electrode can, for example, be electrically coupled capacitively or galvanically to the linear antenna conductor.

It is essential here that the unshielded, linear antenna conductor be situated outside an area defined by a projection operation, which is defined in that each point of the area can be projected by orthogonal parallel projection onto the conductive coating or planar antenna serving as the projection area. If the conductive coating is active only section-wise (in at least a section thereof) as a planar antenna, only the part or section of the conductive coating active as a planar antenna serves as the projection area. The linear antenna conductor is thus not situated in the area defined by the projection operation. As is customary, in the parallel projection, the projection beams are parallel to each other and strike the projection area at a right angle, which projection area is, in the present case, the conductive coating serving as a planar antenna or the part thereof active as a planar antenna, with the center of projection at infinity. With a flat substrate and an accordingly flat conductive coating, the projection area is a projection plane containing the coating. Said area is delimited by an (imagined) edge surface that is positioned on the circumferential edge of the part of the conductive coating active as a planar antenna and is perpendicular to the projection area.

In the hybrid antenna structure according to the present invention, an antenna foot point of the linear antenna becomes a common antenna foot point of the linear and planar antenna. As is customary, the term "antenna foot point" describes an electrical contact for picking up received antenna signals, on which, in particular, a reference to a reference potential (e.g., ground) exists for determining the signal level of the antenna signals.

The antenna structure according to the invention thus has a planar antenna and a linear antenna that are electrically coupled to each other, which is referred to in the context of the present invention as a "hybrid antenna structure". It advantageously enables good reception performance with a high bandwidth which combines the good reception characteristics of the planar emitter in the frequency ranges of bands I and II with the favorable reception characteristics of the linear emitter in the frequency ranges of bands II through V. By means of the positioning of the linear emitter outside the area projectable on the planar antenna by orthogonal parallel projection, electrical load of the linear emitter by the planar emitter can be avoided in a particularly advantageous manner. The hybrid antenna structure according to the invention thus makes available, for the first time, the entire frequency range of bands I through V with a satisfactory reception performance, for example, for a windshield serving as an antenna pane. In industrial series production, the hybrid antenna structure can be produced simply and cost-effectively using current production techniques.

In an advantageous embodiment of the hybrid antenna structure according to the invention, the linear antenna conductor is specially adapted for reception in the range of the terrestrial bands III-V and has, for this purpose, preferably, a length of more than 100 millimeters (mm) and a width of less than 1 mm as well as a height of less than 1 mm, corresponding to a relationship length/width≥100 or L/H≥100. For the desired purpose, it is further preferred for the antenna conductor to have linear conductivity of less than 20 ohm/m, particularly preferably less than 10 ohm/m.

In another advantageous embodiment of the hybrid antenna structure according to the invention, the coupling electrode is electrically coupled to the conductive coating such that the reception performance (signal level) of the planar antenna is as high as possible. This measure advantageously enables optimization of the signal level of the planar antenna or improvement of the reception characteristics of the hybrid antenna structure.

In another advantageous embodiment of the hybrid antenna structure according to the invention, the common antenna foot point of the planar and linear antenna can be electrically conductively connected via a connector conductor to an electronic signal processing device for processing of received antenna signals, for example, an antenna amplifier, with the connector contact disposed such that the length of the connector conductor is as short as possible. This measure advantageously makes it possible that it is not absolutely necessary to use a specific high-frequency conductor for the connector conductor with a signal conductor and at least one accompanying ground conductor, but rather that because of the short signal transmission path, a more economical signal conductor not provided specifically for high frequency transmission, such as an unshielded stranded wire or a strip-shaped flat conductor, that can be connected using a relatively low complexity connection technique, can be used. This makes possible significant cost savings in the production of the hybrid antenna structure.

In another advantageous embodiment of the hybrid antenna structure according to the invention, the conductive coating covers the surface of the substrate except for a circumferential, electrically insulating edge strip, with the linear antenna conductor situated inside an area that can be projected by orthogonal parallel projection onto the edge strip serving as a projection area. For this purpose, the linear antenna conductor can, for example, be applied on the substrate in the region of the edge strip. This measure enables particularly simple production of the hybrid antenna structure.

In another advantageous embodiment of the hybrid antenna structure according to the invention, it is realized in the form of a laminated pane. The laminated pane comprises two preferably transparent first substrates, which correspond to an inner and outer pane that are fixedly bonded to each other by at least one thermoplastic adhesive layer. In this case, the conductive coating can be situated on at least one surface of at least one of the two first substrates of the laminated pane. Moreover, the laminated pane can be provided with another second substrate different from the first substrate that is situated between the two first substrates. The second substrate can serve additionally or alternatively to the first substrate as a carrier for the conductive coating, with at least one surface of the second substrate provided with the conductive coating. By means of this measure, the hybrid antenna structure according to the invention can be realized particularly simply from a technical standpoint.

In another advantageous embodiment of the hybrid antenna structure according to the invention, the conductive coating is situated on one surface of the at least one substrate and the linear antenna conductor is situated on a different surface therefrom of the same or a different substrate therefrom. By means of this measure, particularly simple production of the hybrid antenna structure according to the invention can be realized.

In another advantageous embodiment of the hybrid antenna structure according to the invention, the coupling electrode and the antenna conductor are electrically conductively connected to each other via a first connection conductor, with, in particular, the capability provided to design the coupling electrode independent of the electrical connection to the linear antenna conductor, by which means the performance of the hybrid antenna structure can be improved.

In another advantageous embodiment of the hybrid antenna structure according to the invention, the antenna conductor is situated on one surface of the at least one substrate and the common antenna foot point is situated on a different surface therefrom of the same or of a different substrate therefrom. For this purpose, the antenna conductor and the common antenna foot point are electrically conductively connected to each other via a second connection conductor. By means of this measure, the electrical connection of the common antenna foot point with the downstream antenna electronics can be realized particularly simply.

In another advantageous embodiment of the hybrid antenna structure according to the invention, the linear antenna conductor made of a metallic printing paste is printed, for example, using the screenprinting method, onto the at least one substrate or is laid in the form of a wire, by which means particularly simple production of the antenna conductor is enabled.

In another advantageous embodiment of the hybrid antenna structure according to the invention, at least one of the conductors, selected from among the coupling electrode, the first connection conductor, and the second connection conductor, leads to the edge of the at least one substrate and is implemented as a strip-shaped flat conductor with a tapering width in the region of the edge. By means of this measure, a reduced coupling surface can be advantageously obtained on the substrate edge, for example, with the conductor coming out of the laminated pane for reduction of a capacitive coupling with the electrically conductive motor vehicle body.

In another advantageous embodiment of the hybrid antenna structure according to the invention, the linear antenna and the coupling electrode as well as the two connection conductors (if present) are masked by an opaque masking layer, by means of which the visual appearance of the antenna structure can be improved.

In another advantageous embodiment of the hybrid antenna structure according to the invention, the conductive coating comprises at least two planar segments that are electrically isolated from each other by at least one linear, electrically insulating region. In addition, at least one planar segment is divided by linear, electrically insulating regions. It is particularly advantageous if an, in particular, circumferential edge region of the conductive coating has a plurality of planar segments that are divided by linear, electrically insulating regions. Such a configuration of the conductive coating is described in detail in the unpublished international patent application PCT/EP2009/066237 already mentioned in the introduction. To avoid repetition, reference is made to the publication of this patent application in its entirety, which is thus to be considered part of the description of the present invention. The linear antenna conductor can be disposed at least section-wise (at least in a section thereof), in particular completely, in the region of such planar, electrically insulated segments. In particular, the linear antenna conductor can be disposed at least section-wise (at least in a section thereof), in particular completely, inside an area that can be projected by orthogonal parallel projection onto the region of such planar, electrically insulated segments serving as a projection area.

The invention further extends to a method for producing a hybrid antenna structure, comprising the following steps:

- covering at least one section of at least one surface of at least one electrically insulating, preferably transparent substrate with at least one electrically conductive, preferably transparent coating, which serves as a planar antenna for reception of electromagnetic waves;
- forming at least one unshielded, linear antenna conductor, which serves as a linear antenna for reception of electromagnetic waves, wherein the antenna conductor is situated outside an area that can be projected by orthogonal parallel projection onto the planar antenna;
- producing at least one coupling electrode, which is electrically coupled to the conductive coating and to the linear antenna conductor.

In an advantageous embodiment of the method, the linear antenna conductor is printed by means of a metallic printing paste onto the at least one substrate or is laid in the form of a wire, in particular, between two substrates bonded together in the form of a laminated pane.

The invention further extends to the use of a hybrid antenna structure as described above as a functional and/or decorative individual piece and as a built-in part in furniture, devices, and buildings, as well as in means of transportation for travel on land, in the air, or on water, in particular in motor vehicles, for example, as a windshield, a rear window, a side window, and/or a glass roof.

It is understood that the various embodiments of the antenna structure according to the invention can be realized individually or in any combinations. In particular, the above mentioned characteristics and those to be illustrated in the following can be used not only in the combinations indicated, but also in other combinations or alone without departing from the context of the present invention.

BRIEF DESCRIPTION OF THE DRAWINGS

The invention is now explained in detail based on exemplary embodiments, with reference to the accompanying figures. They depict in simplified representation that is not to scale.

DETAILED DESCRIPTION OF THE DRAWINGS

Figure 1:
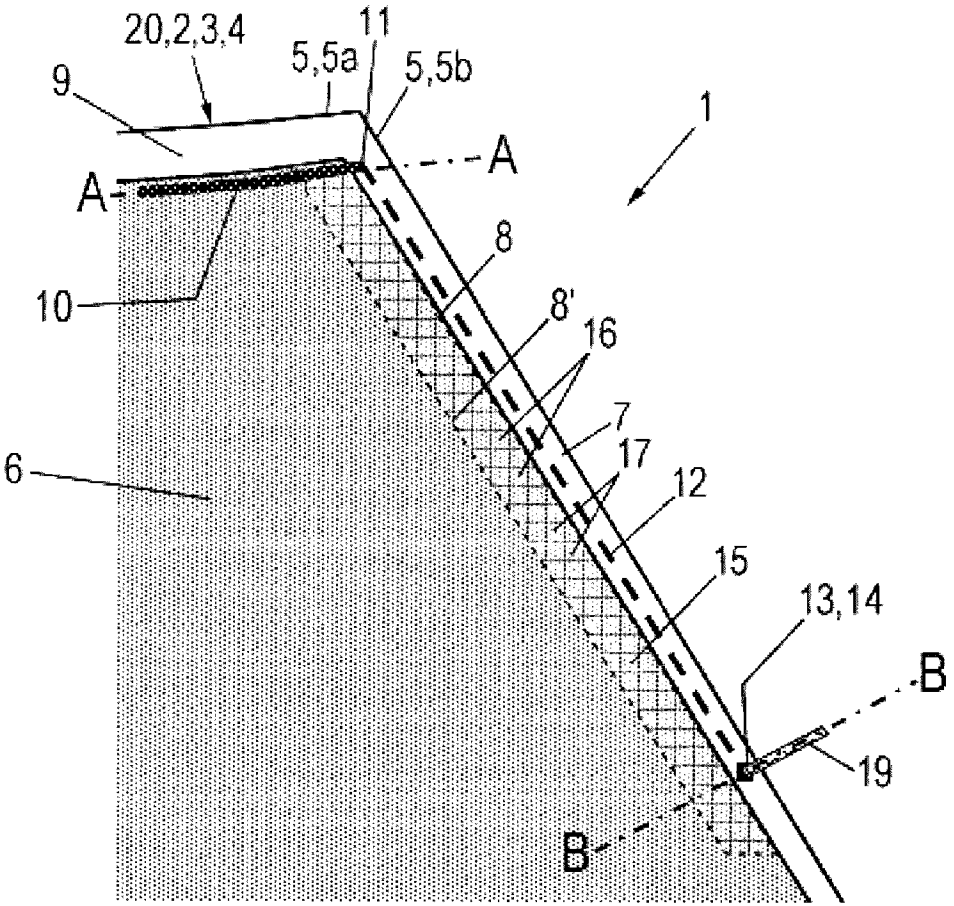
FIG. 1 a schematic perspective view of a hybrid antenna structure according to a first exemplary embodiment of the invention embodied in the form of a laminated pane.
Figure 2A:
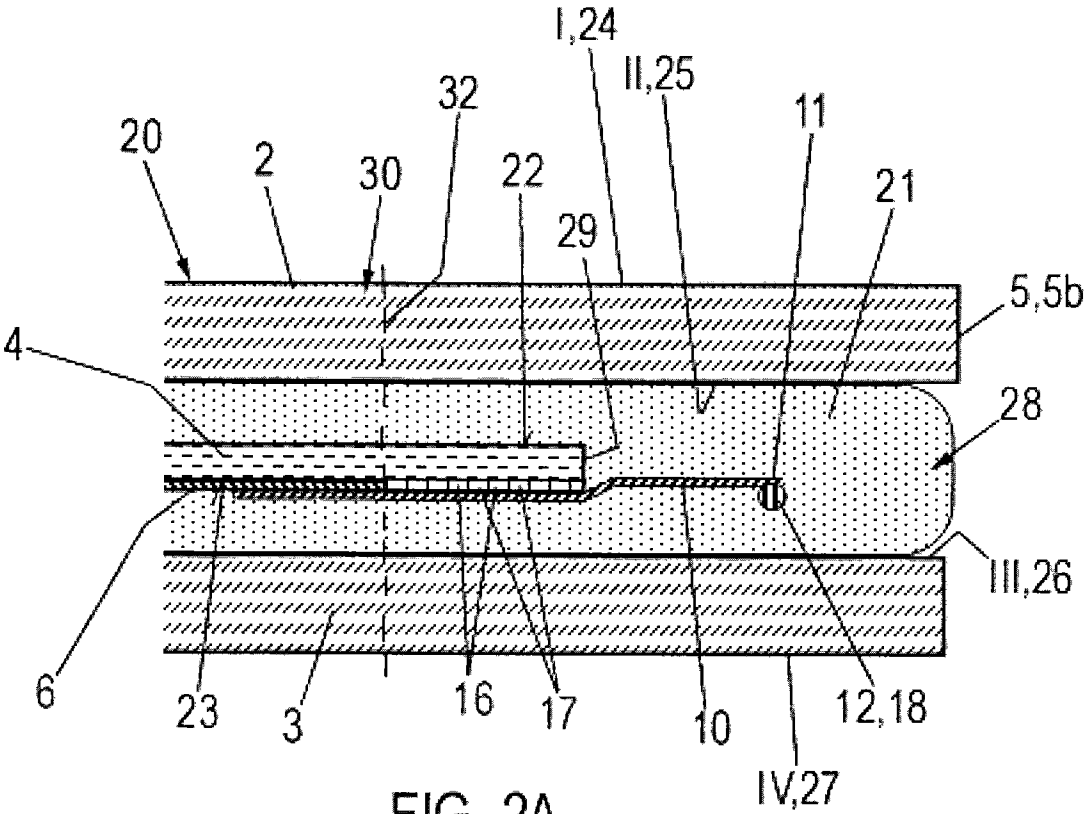
FIG. 2A-2B cross-sectional views of the hybrid antenna structure of FIG. 1 along section line A-A (FIG. 2A) and section line B-B (FIG. 2B)
Figure 2B:
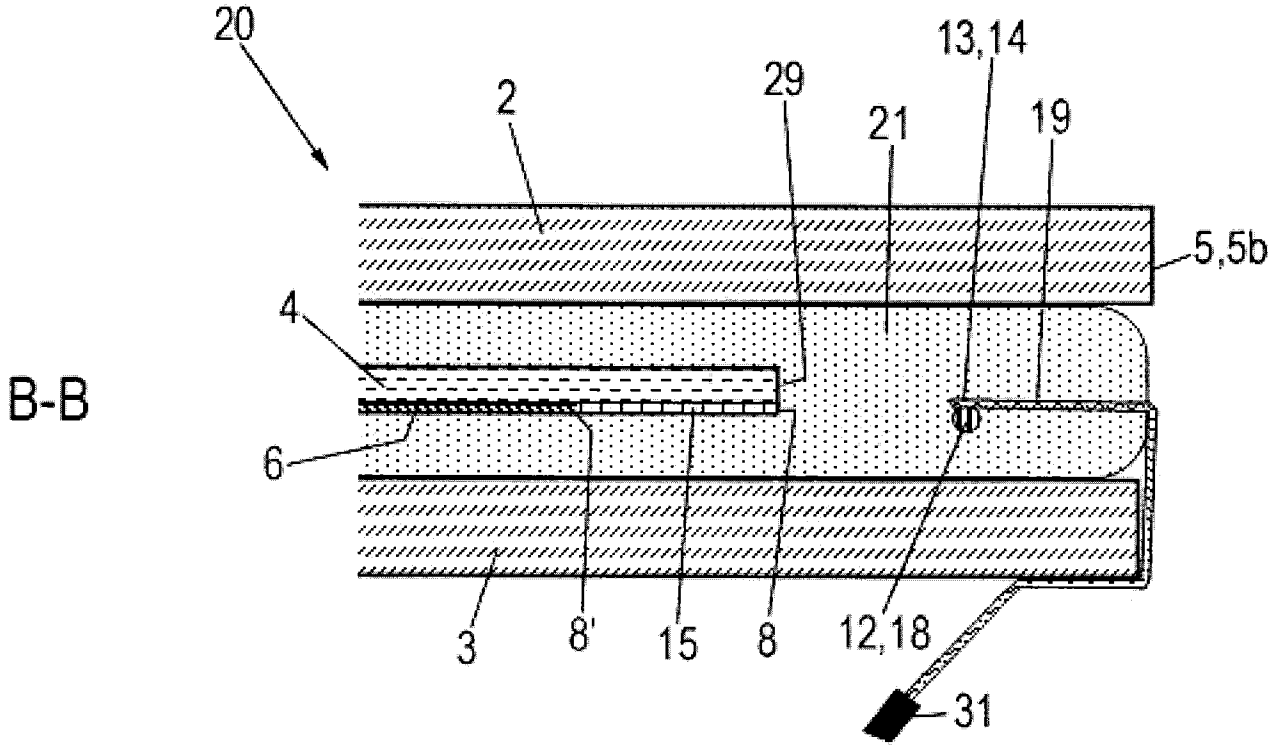

FIGS. 1, 2A and 2B are considered first, wherein a hybrid antenna structure, referred to as a whole by the reference character 1, is illustrated as a first exemplary embodiment of the invention. In this case, the hybrid antenna structure 1 is embodied, for example, as a transparent laminated pane 20, which is only partially depicted in FIG. 1. The laminated pane 20 is transparent to visible light, for example, in the wavelength range from 350 nm to 800 nm, with the term "transparency" meaning light permeability of more than 50%, preferably more than 75%, and, particularly preferably more than 80%. The laminated pane 20 serves, for example, as a windshield of a motor vehicle, but it can also be used otherwise.

The laminated pane 20 comprises two transparent individual panes, namely a rigid outer pane 2 and a rigid inner pane 3, that are fixedly bonded to each other by a transparent thermoplastic adhesive layer 21. The individual panes have roughly the same size and are made, for example, from glass, in particular, float glass, cast glass, and ceramic glass, being equally possibly made from a non-glass material, for example, plastic, in particular polystyrene (PS), polyamide (PA), polyester (PE), polyvinyl chloride (PVC), polycarbonate (PC), polymethyl methacrylate (PMA), or polyethylene terephthalate (PET). Generally speaking, any material with sufficient transparency, adequate chemical resistance, as well as suitable shape and size stability can be used. For use elsewhere, for example, as a decorative piece, it would also be possible to make the outer and inner panes 2, 3 from a flexible material. The respective thickness of the outer and inner panes 2, 3 can vary widely depending on the application and, for glass, can, for example, be in the range from 1 to 24 mm.

The laminated pane 20 has an at least approximately trapezoidal curved contour (in FIG. 1 only partially discernible), which results from a common edge of the pane 5 made of the two individual panes 2, 3, with the edge of the pane 5 composed of two opposing long edges of the pane 5*a* and two opposing short edges of the pane 5*b*. In the conventional manner, the surfaces of the panes are referenced with Roman numerals I-IV, with "side I" corresponding to a first pane surface 24 of the outer pane 2; "side II", a second pane surface 25 of the outer pane 2; "side III", a third pane surface 26 of the inner pane 3; and "side IV", a fourth pane surface 27 of the inner pane 3. In the application as a windshield, side I is turned toward the outside environment and side IV is turned toward the passenger compartment of the motor vehicle.

The adhesive layer 21 for bonding the outer and inner pane 2, 3 is preferably made of an adhesive plastic, preferably based on polyvinyl butyral (PVB), ethylene vinyl acetate (EVA), and polyurethane (PU). In this case, the adhesive layer 21 is implemented, for example, as a bilayer in the form of two PVB films bonded together (not shown in detail in the figures).

Situated between the outer and inner pane 2, 3 is a an extensive carrier 4, preferably made from plastic, preferably based on polyamide (PA), polyurethane (PU), polyvinyl chloride (PVC), polycarbonate (PC), polyester (PE), and polyvinyl butyral (PVB), particularly preferably based on polyester (PE) and polyethylene terephthalate (PET). In this case, the carrier 4 is implemented, for example, in the form of a PET film. The carrier 4 is embedded between the two PVB films of the adhesive layer 21 and disposed parallel to the outer and inner pane 2, 3 roughly centered between the two, with a first carrier surface 22 facing the second pane surface 25 and a second carrier surface 23 facing the third pane surface 26. The carrier 4 does not extend all the way to the edge of the pane 5, such that a carrier edge 29 is set back inward relative to the edge of the pane 5 and a carrier-free circumferential edge zone 28 of the laminated 20 remains on all sides. The edge zone 28 serves in particular as electrical insulation of the conductive coating 6 toward the outside, for example, for reduction of a capacitive coupling with the electrically conductive motor vehicle body made, as a rule, from sheet metal. Moreover, the conductive coating 6 is protected against corrosion penetrating from the edge of the pane 5.

Applied on the second carrier surface 23 is a transparent, electrically conductive coating 6, which is delimited on all sides by a circumferential coating edge 8. The conductive coating 6 covers an area, which is more than 50%, preferably more than 70%, particularly preferably more than 80%, and even more preferably more than 90% of the surface of the second pane surface 25 or of the third pane surface 26. The area covered by the conductive coating 6 preferably amounts to more than 1 $m^2$ and can, generally speaking, despite the use of the laminated pane 20 as a windshield, be in the range from 100 $cm^2$ to 25 $m^2$. The transparent, electrically conductive coating 6 contains or is made of at least one electrically conductive material. Examples for this are metals with high electrical conductivity such as silver, copper, gold, aluminum, or molybdenum, metal alloys such as silver alloyed with palladium, as well as transparent, electrically conductive oxides (TCOs=transparent conductive oxides). Preferred TCOs are indium tin oxide, fluoride-doped tin dioxide, aluminum-doped tin dioxide, gallium-doped tin dioxide, boron-doped tin dioxide, tin zinc oxide, or antimony-doped tin oxide.

The conductive coating 6 can consist of one individual layer with such a conductive material or of a layer sequence that contains at least one such individual layer. For example, the layer sequence can comprise at least one layer made of a conductive material and at least one layer made of a dielectric material. The thickness of the conductive coating 6 can vary widely depending on the application, with the thickness at any location in the range from 30 nm to 100 μm. In the case of TCOs, the thickness is preferably in the range from 100 nm to 1.5 μm, more preferably in the range from 150 nm to 1 μm, particularly preferably in the range from 200 nm to 500 nm. When the conductive coating consists of a layer sequence with at least one layer made of an electrically conductive material and at least one layer made of a dielectric material, the thickness is preferably 20 nm to 100 μm, more preferably 25 nm to 90 μm, and particularly preferably 30 nm to 80 μm. The layer sequence advantageously has high thermal stability such that it withstands, without damage, the temperatures of typically more than 600° C. necessary for the bending of glass panes; however, layer sequences with low thermal stability can also be provided. The sheet resistance of the conductive coating 6 is preferably less than 20 ohms per unit of area and and is, for example, in the range from 0.5 to 20 ohms per unit of area. In the exemplary embodiment depicted, the sheet resistance of the conductive coating 6 is, for example, 4 ohms per unit of area.

The conductive coating 6 is preferably deposited from the gas phase, for which purpose methods known per se, such as chemical vapor deposition (CVD) or physical vapor deposition (PVD), can be used. Preferably, the coating 6 is applied by sputtering (magnetron cathode sputtering).

In the laminated pane 20, the conductive coating 6 serves as a planar antenna for reception of electromagnetic waves, preferably in the frequency range of the terrestrial broadcast bands I and II. For this purpose, the conductive coating 6 is electrically coupled to a coupling electrode 10, which is implemented in this case, for example, as a strip-shaped flat conductor. In the exemplary embodiment, the coupling electrode 10 is galvanically coupled to the conductive coating 6, with a capacitive coupling equally possibly provided. The strip-shaped coupling electrode 10 is made, for example, from a metallic material, preferably silver, and is, for example, printed on by screenprinting. It has, preferably, a length of more than 10 mm with a width of 5 mm or more, more preferably a length of more than 25 mm with a width of 5 mm or more. In the exemplary embodiment, the coupling electrode 10 has a length of 300 mm and a width of 5 mm. The thickness of the coupling electrode is preferably less than 0.015 mm. The specific conductivity of a coupling electrode 10 made of silver is, for example, $61.35 \cdot 10^6$/ohm·m.

As depicted in FIG. 1, the coupling electrode 10 runs on and in direct electrical contact with the conductive coating 6 roughly parallel to the upper coating edge 8 and extends into the carrier-free edge zone 28. In this case, the coupling electrode 10 is disposed such that the antenna signal of the planar antenna is optimized with regard to its reception performance (signal level).

As depicted in FIGS. 2A and 2B, the conductive coating 6 is divided, in a strip-shaped edge region 15 adjacent the carrier edge 29, for example, by lasering, into a plurality of electrically insulated segments 16, between which, in each case, electrically insulating (stripped) regions 17 are situated. The edge region 15 runs substantially parallel to the carrier surface 24 and can, in particular, be circumferential on all sides. As is disclosed in the unpublished international patent application PCT/EP 2009/066237 already mentioned in the introduction, by means of these measures, a capacitive coupling of the conductive coating 6 with surrounding conductive structures, for example, an electrically conductive motor vehicle body, is advantageously thwarted. Since the edge region 15 of the conductive coating 6 is not active as a planar antenna, a part of the conductive coating 6 active for the function as a planar antenna is delimited by a coating edge 8'.

Within the carrier-free edge zone 28 of the laminated pane 20, embedded in the adhesive layer 4, a linear, unshielded antenna conductor 12 is situated, which serves as a linear antenna for reception of electromagnetic waves, preferably in the frequency range of the terrestrial broadcast bands II through V, particularly preferably in the frequency range of the broadcast bands III through V and is suitably configured for this purpose. In the present exemplary embodiment, the antenna conductor 12 is implemented in the form of a wire 18, which is preferably longer than 100 mm and narrower than 1 mm. The linear conductivity of the antenna conductor 12 is preferably less than 20 ohm/m, particularly preferably less than 10 ohm/m. In the embodiment depicted, the length of the antenna conductor 12 is ca. 650 mm with a width of 0.75 mm. Its linear conductivity is, for example, 5 ohm/m.

The antenna conductor 12 has, in this case, for example, an at least approx. straight-line course and is located completely within the carrier-free and coating-free edge zone 28 of the laminated pane 20, running primarily along the short edge of the pane 5*b*, for example, under a motor vehicle lining (not shown) in the region of the masking strip 9. The antenna conductor 12 has an adequate distance both from the edge of the pane 5 and from the coating edge 8, by means of which a capacitive coupling to the conductive coating 6 and the motor vehicle body is thwarted. In particular, it is advantageously achieved by means of the segmented edge region 15 that the distance between the conductive coating 6 and the linear antenna effective for high-frequency applications is enlarged.

Since the antenna conductor 12 is situated outside an area 30 indicated schematically in FIG. 2A, which is defined in that every point contained therein can be imaged by orthogonal parallel projection onto the conductive coating 6 serving as a planar antenna and representing a projection area (or onto the part of the conductive coating 6 active as a planar antenna), the linear antenna is not electrically affected by the planar antenna. This area 30 defined by a projection operation is delimited by an imagined bounding surface 32, which is disposed on the coating edge 8 or 8' and is aligned perpendicular to the carrier 21. For the segmented edge region 15, the bounding surface 32 is disposed on the coating edge 8', since the antenna function of the conductive coating 6 is important for the positioning of the antenna conductor 12. For this reason, it would be equally possible for the linear antenna conductor 12 to be disposed at least section-wise, in particular completely, inside the segmented edge region 15. In other words, the linear antenna conductor 12 could also be disposed, at least section-wise, inside an area that is defined by the fact that every point contained therein can be imaged by orthogonal parallel projection onto the segmented edge region 15 representing a projection area. This variant is also encompassed by the invention.

The coupling electrode 10 is electrically coupled on a first connector contact 11 (not shown in detail) to the linear antenna conductor 12. In the present exemplary embodiment, the coupling electrode 10 is galvanically coupled to the antenna conductor 12, with the provision of a capacitive coupling equally possible. Although this is not depicted in the figures, at least one further electrical coupling (coupling point or contact point) could equally be provided between the planar antenna, in particular the coupling electrode 10, and the linear antenna conductor 12. The first connector contact 11 of the coupling electrode 10 or the connection point between the coupling electrode 10 and the antenna conductor 12 can be considered as an antenna foot point for the pickup of antenna signals of the planar antenna. However, a second connector contact 14 of the antenna conductor 12 actually serves as a common antenna foot point 13 for the pickup of the antenna signals of both the planar antenna and the linear antenna. The antenna signals of the planar antenna and of the linear antenna are thus made available on the second connector contact 14.

The second connector contact 14 is electrically coupled to a connector conductor 19 acting parasitically as an antenna. In the present exemplary embodiment, the connector conductor 19 is galvanically coupled to the second connector contact 14, but with the provision of a capacitive coupling equally possible. The hybrid antenna structure 1 is electrically connected, via the connector conductor 19 and a connector 31 connected thereto, to downstream electronic components, for example, an antenna amplifier, with the antenna signals led out of the laminated pane 20 through the connector conductor 19. As is depicted in FIG. 2B, the connector conductor 19 extends from the adhesive layer 21 past the edge of the pane 5 to the fourth pane surface 27 (side IV), and then leads away from the laminated pane 20. The spatial position of the second connector contact 14 is selected such that the connector conductor 19 is as short as possible and its parasitic effect as an antenna is minimized such that it is possible to do without the use of a conductor specifically designed for high-frequency applications. The connector conductor 19 is preferably shorter than 100 mm. Accordingly, the connector conductor 19 is implemented, in this case, for example, as an unshielded stranded wire or foil conductor that is cost-effective and space-saving and, in addition, can be connected using a relatively simple connection method. The width of the connector conductor 19 implemented in this case, for example, as a flat conductor, tapers, preferably toward the edge of the pane 5, to thwart capacitive coupling with the motor vehicle body.

In the hybrid antenna structure 1, the transparent, electrically conductive coating 6 can, depending on material composition, fulfill other functions. For example, it can serve as a heat-ray reflecting coating for the purpose of solar protection, thermoregulation, or heat insulation or as a heating layer for the electrical heating of the laminated pane 20. These functions are of secondary importance for the present invention.

Furthermore, the outer pane 2 is provided with an opaque color layer that is applied on the second pane surface 25 (side II) and forms a frame-like circumferential masking strip 9, which is not depicted in detail in the figures. The color layer is made, preferably, of an electrically non-conductive, black pigmented material that can be baked into the outer pane 2. On the one hand, the masking strip 9 prevents the visibility of an adhesive strand with which the laminated pane 20 can be glued into a motor vehicle body; on the other, it serves as UV protection for the adhesive material used.

Figure 3A:
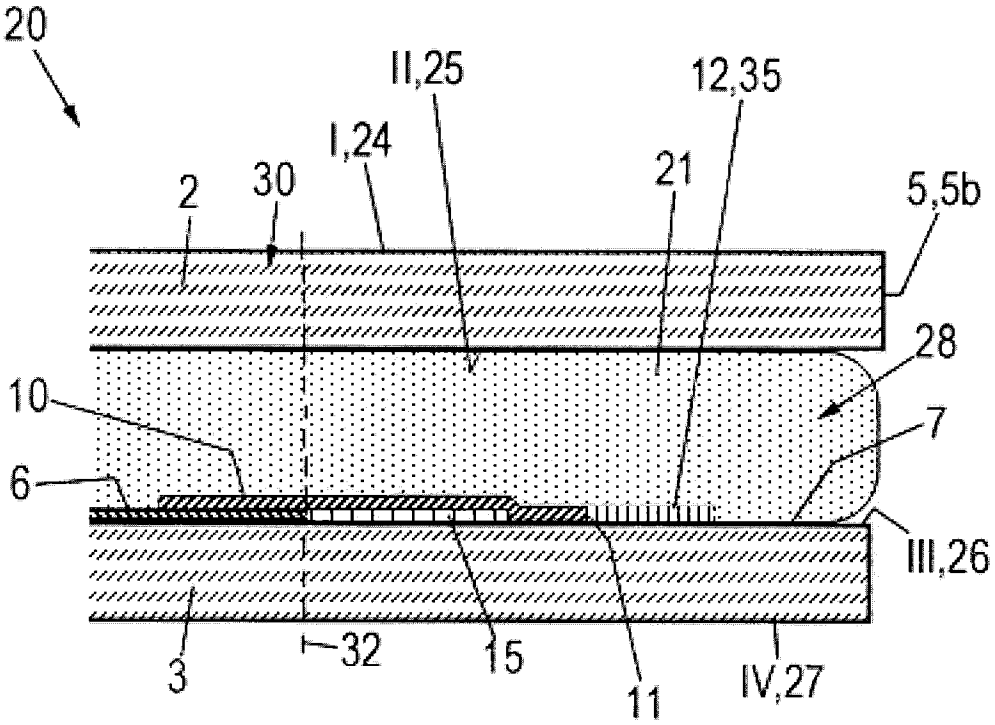
FIG. 3A-3B cross-sectional views of a first variant of the hybrid antenna structure of FIG. 1 along section line A-A (FIG. 3A) and section line B-B (FIG. 3B)
Figure 3B:
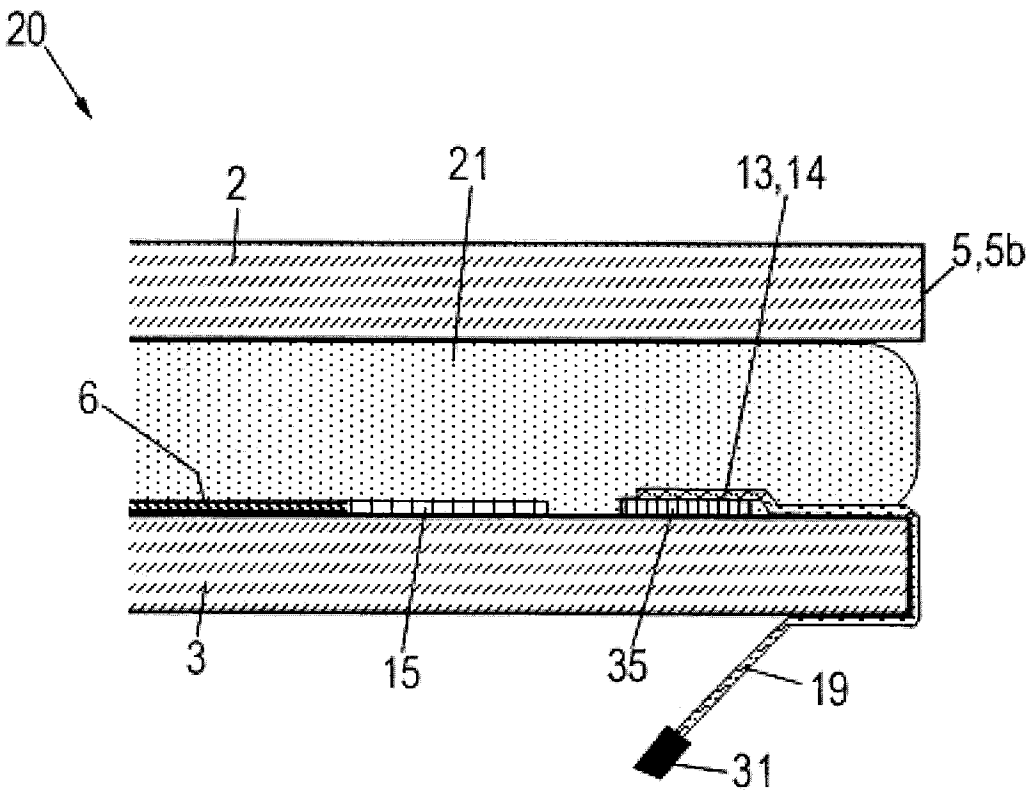

Reference is now made to FIGS. 3A and 3B, in which a first variant of the hybrid antenna structure 1 is depicted. In order to avoid unnecessary repetition, only the differences relative to the exemplary embodiment of FIGS. 1, 2A, and 2B are described; and, for the rest, reference is made to the statements made there.

According to this variant, no carrier 4 for the conductive coating 6 is provided in the laminated pane 20, as the conductive coating 6 is applied on the third pane surface 26 (side III) of the inner pane 3. The conductive coating 6 does not reach all the way to the edge of the pane 5, such that a circumferential, coating-free edge strip 7 remains on all sides of the third pane surface 26. The width of the circumferential edge strip 7 can vary widely. Preferably, the width of the edge strip 7 is in the range from 0.2 to 1.5 cm, more preferably in the range from 0.3 to 1.3 cm, and particularly preferably in the range from 0.4 to 1.0 cm. The edge strip 7 serves in particular for electrical insulation of the conductive coating 6 toward the outside and for reduction of a capacitive coupling to surrounding conductive structures. The edge strip 7 can be produced by later removal of the conductive coating 6, for example, by abrasive ablation, laser ablation, or etching, or by masking the inner pane 3 before the application of the conductive coating 6 on the third pane surface 26.

The antenna conductor 12 serving as a linear antenna is applied on the third pane surface 26 in the region of the coating-free edge strip 7. In the variant depicted, the antenna conductor 12 is implemented in the form of a flat conductor path 35, which is preferably applied by printing, for example, by screenprinting, of a metallic printing paste. Thus, the linear antenna and the planar antenna are situated on the same surface (side III) of the inner pane 3. The strip-shaped coupling electrode 10 extends to above the linear antenna conductor 12 and is galvanically coupled thereto, with the provision of a capacitive coupling equally possible. As already stated above, it would equally be possible—since the segmented edge region 15 fulfills no antenna function—for the antenna conductor 12, 35 implemented as a conductor path to be disposed, at least section-wise, in particular completely, inside the segmented edge region 15. In other words, the antenna conductor 12, 35 in path form could be disposed, at least section-wise, in particular completely inside an area that is defined in that every point contained therein can be imaged by orthogonal parallel projection onto the segmented edge region 15 representing a projection area.

The antenna conductor 12 is situated outside the area 30 indicated schematically in FIG. 3A, in which every point can be imaged by orthogonal parallel projection onto the planar antenna, such that the linear antenna is not electrically loaded by the planar antenna. FIG. 3A depicts schematically the (imagined) bounding surface 32 delimiting the area 30, which is aligned perpendicular to the third pane surface 26 and is disposed on the coating edge 8 or 8' (in the edge region 15). In other words, the linear antenna conductor 12 is situated in an area not characterized in detail, in which every point can be imaged by orthogonal parallel projection onto the coating-free edge strip 7 serving as a projection area. Electrical loading of the linear antenna by the planar antenna is advantageously avoided in this manner.

Figure 4A:
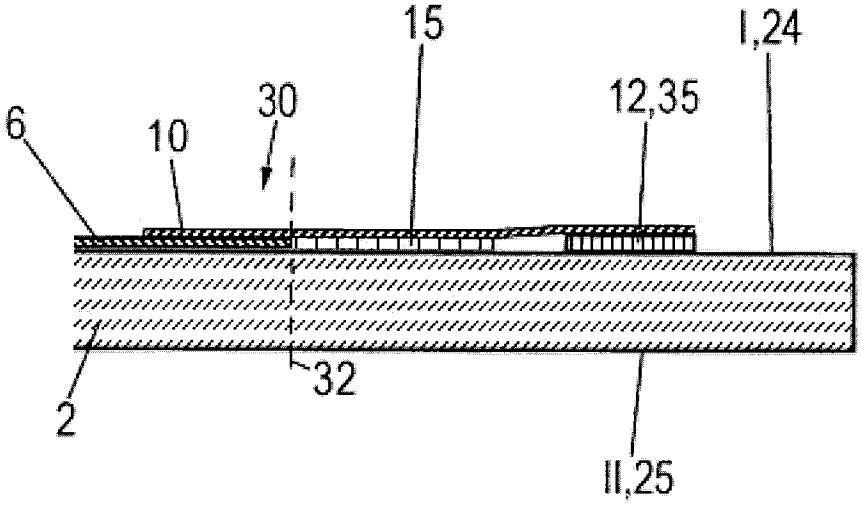
FIG. 4A-4B cross-sectional views of a second variant of the hybrid antenna structure of FIG. 1 along section line A-A (FIG. 4A) and section line B-B (FIG. 4B)
Figure 4B:
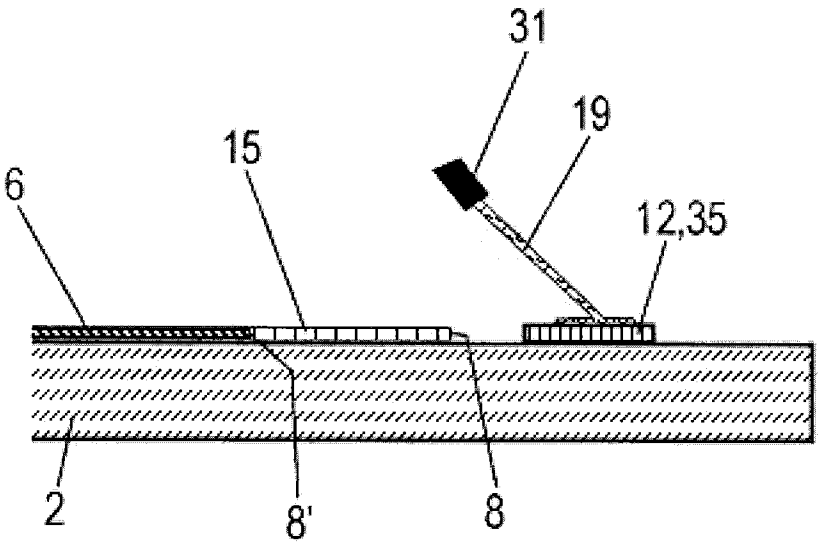

FIGS. 4A and 4B depict a second variant of the hybrid antenna structure 1, with only the differences relative to the first variant of FIGS. 3A and 3B described, and, for the rest, reference is made to the statements made there.

According to this variant, no laminated pane 20 is provided, but rather only a single pane glass with one individual pane corresponding, for example, to outer pane 2. The conductive coating 6 is applied on the first pane surface 24 (side I), with the conductive coating 6 not reaching all the way to the edge of the pane 5 such that a circumferential, coating-free edge strip 7 on all sides of the first pane surface 24 remains. In the region of the coating-free edge strip 7, the linear antenna conductor 12 implemented in the form of a conductor path 35 and serving as a linear antenna is applied on the first pane surface 24. The antenna conductor 12 is thus situated outside the area 30 schematically indicated in FIG. 4A, in which every point can be imaged by orthogonal parallel projection onto the planar antenna. The connector conductor 19 makes contact with the second connector contact 14 of the antenna conductor 12 and then leads on the same side of the outer pane 2 away from the antenna conductor 12.

Figure 5A:
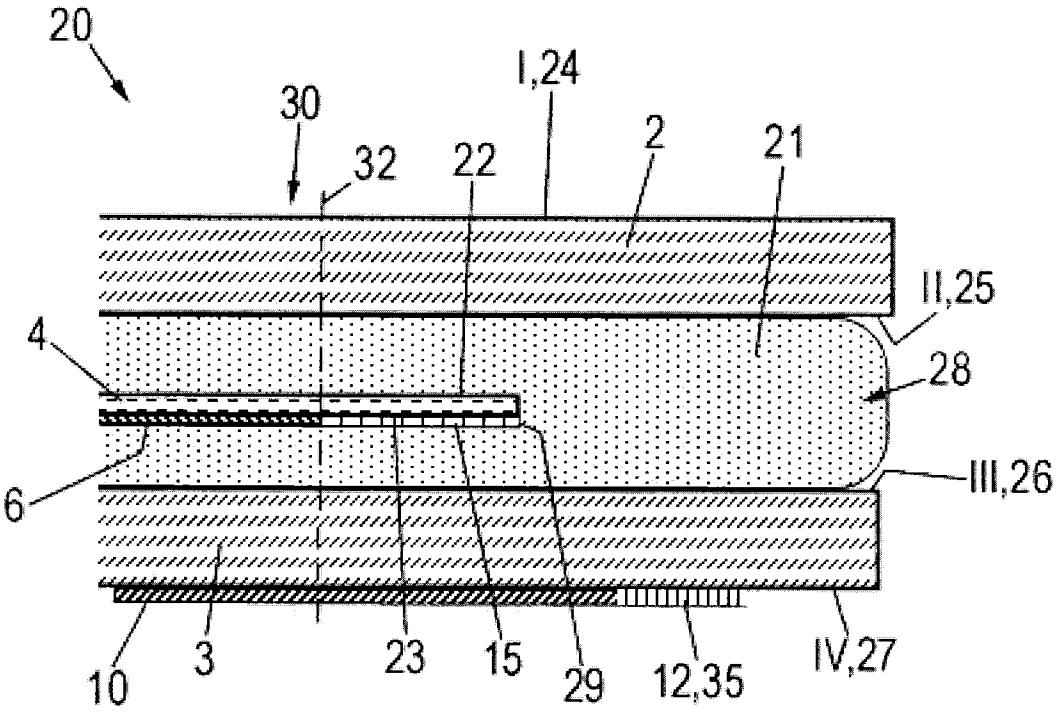
FIG. 5A-5B cross-sectional views of the third variant of the hybrid antenna structure of FIG. 1 along section line A-A (FIG. 5A) and section line B-B (FIG. 5B)
Figure 5B:
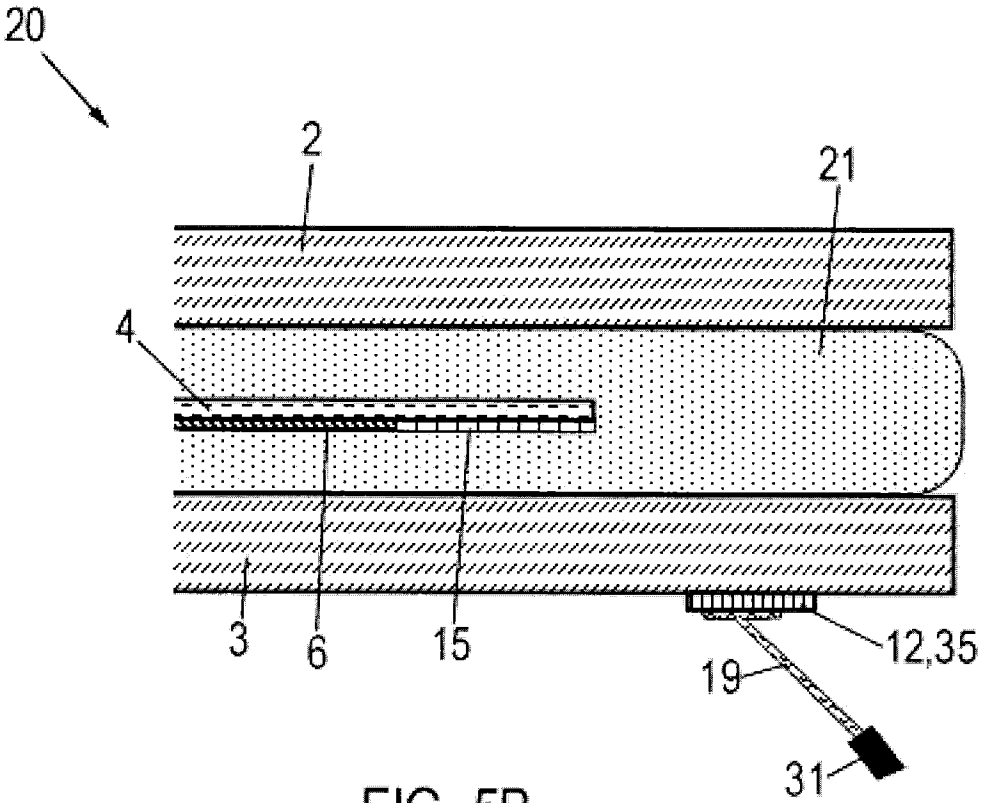

FIGS. 5A and 5B depict a third variant of the hybrid antenna structure 1, with only the differences relative to the first exemplary embodiment of FIGS. 1, 2A, and 2B described, and, for the rest, reference is made to the statements made there.

According to this variant, a carrier 4 is provided in the laminated pane 20, on which carrier the conductive coating 6 is applied. The strip-shaped coupling electrode 10 is applied on the fourth surface (side IV) of the inner pane 3 and capacitively coupled to the conductive coating 6 serving as a planar antenna. The antenna conductor 12 serving as a linear antenna is likewise applied on the fourth pane surface 27 of the inner pane 3, for example, by printing, for example, screenprinting, and galvanically coupled to the coupling electrode, but with the provision of a capacitive coupling equally possible. Thus, the planar antenna and the linear antenna are situated on different surfaces of substrates different from each other. The antenna conductor 12 is situated outside the area 30, in which every point can be imaged by orthogonal parallel projection onto the planar antenna 6 such that the linear antenna is not electrically loaded by the planar antenna. The connector conductor 19 makes contact with the antenna conductor 12 and leads directly away from the laminated pane 20.

Figure 6:
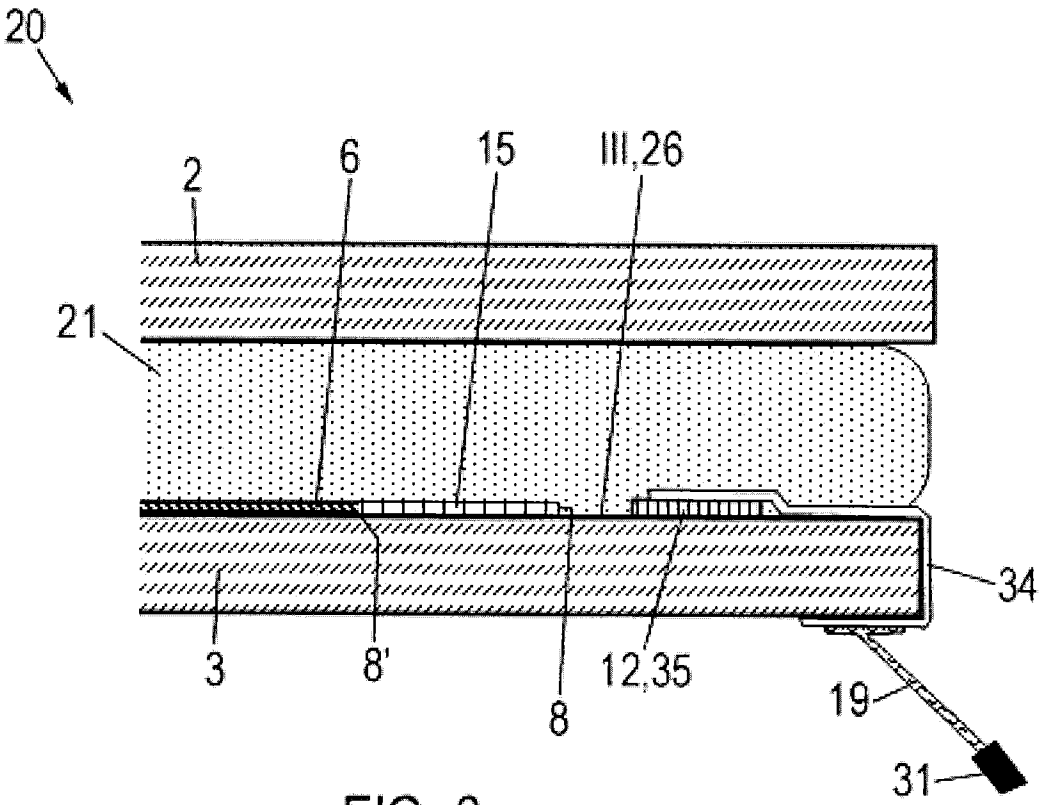
FIG. 6 a cross-sectional view of a fourth variant of the hybrid antenna structure of FIG. 1 along section line B-B.

FIG. 6 depicts a fourth variant of the hybrid antenna structure 1, with only the differences relative to the third variant of FIGS. 5A and 5B described, and, for the rest, reference is made to the statements made there.

According to this variant, the linear antenna conductor 12 configured as a flat conductor path 35 is applied on the third pane surface 26 of the inner pane 3. A second connection conductor 34 is applied on the antenna conductor 12 in the antenna foot point and and extends beyond the short edge of the pane 5*b* to the fourth pane surface 27 (side IV) of the inner pane 3. In the variant depicted, the second connection conductor 34 is galvanically coupled to the antenna conductor 12, with the provision of a capacitive coupling equally possible. The second connection conductor 34 can be manufactured, for example, from the same material as the coupling electrode 10. The connector conductor 19 makes contact with the second connection conductor 34 on the fourth pane surface 27 and leads away from the laminated pane 20. The width (dimension perpendicular to the extension direction) of the second connection conductor 34 configured as a strip-shaped flat conductor preferably tapers toward the short edge of the pane 5*b* such that a capacitive coupling between the conductive coating 6 and the electrically conductive motor vehicle body can be prevented.

Figure 7:
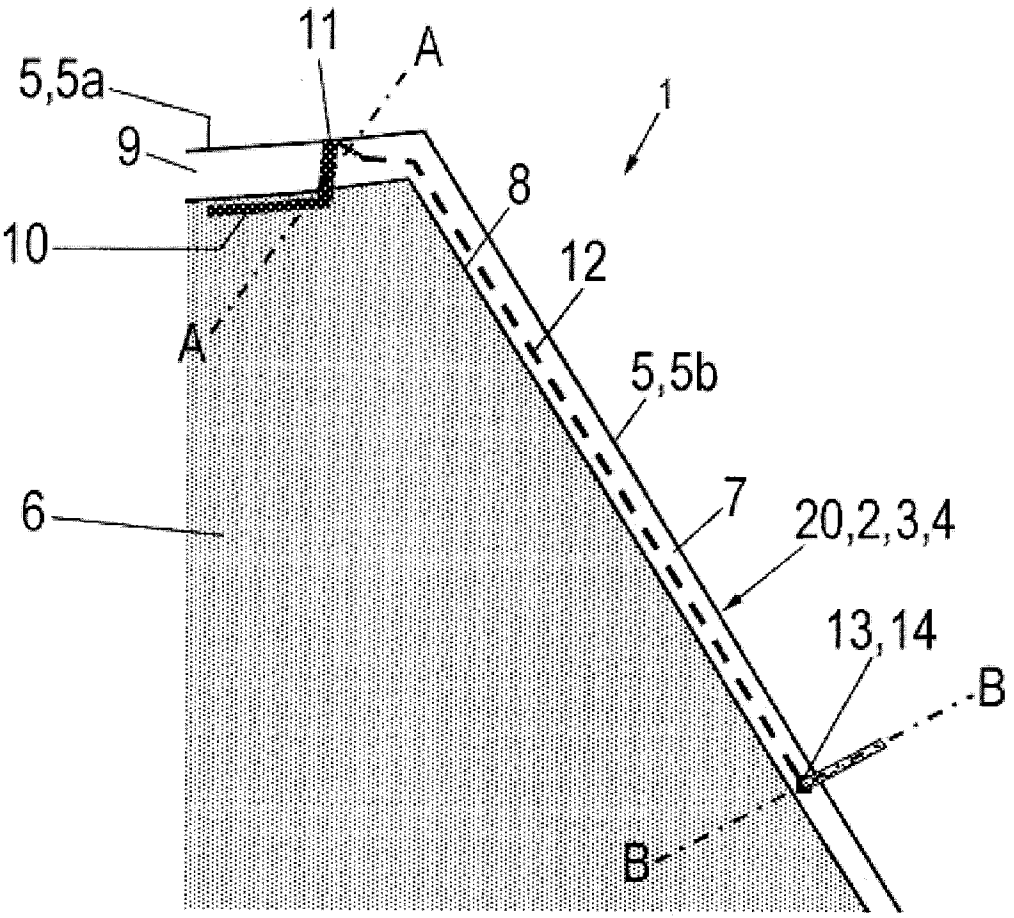
FIG. 7 a schematic perspective view of a hybrid antenna structure according to a second exemplary embodiment of the invention embodied in the form of a laminated pane.
Figure 8A:
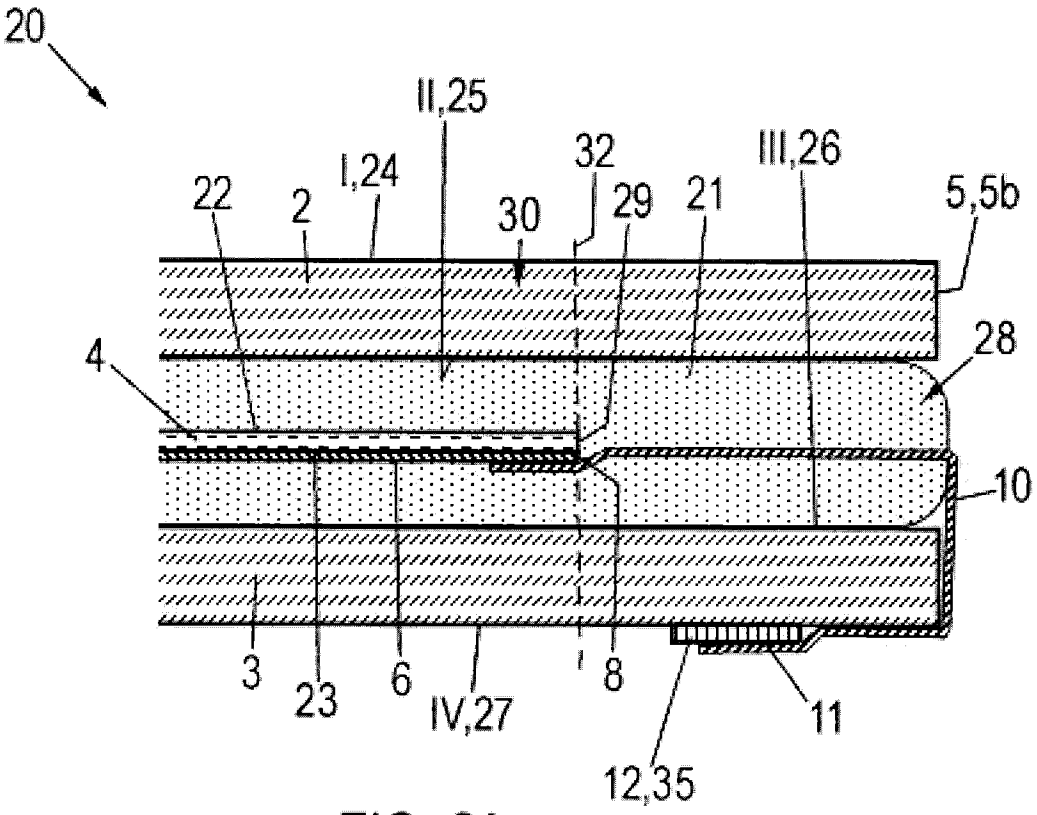
FIG. 8A-8B cross-sectional views of the hybrid antenna structure of FIG. 7 along section line A-A (FIG. 8A) and section line B-B (FIG. 8B)
Figure 8B:
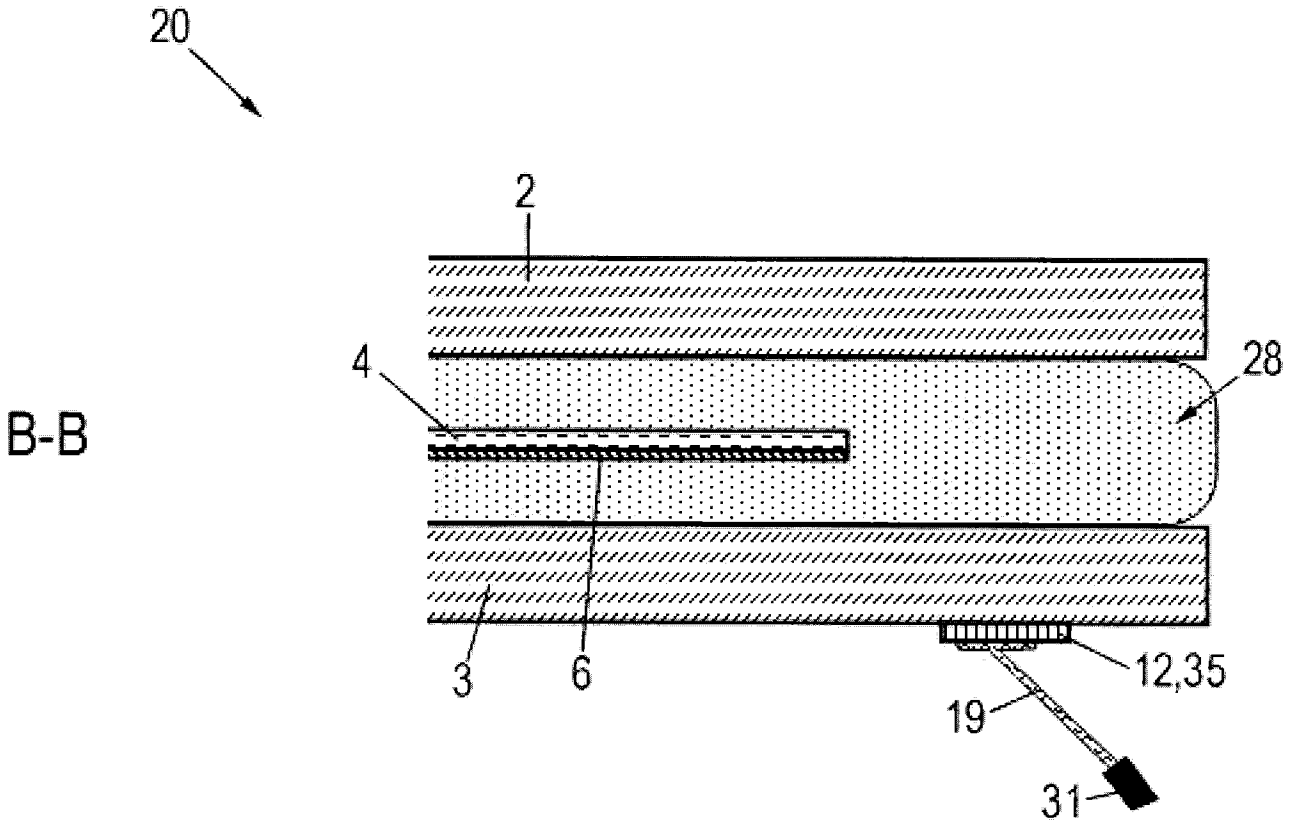

FIGS. 7, 8A, and 8B depict a second exemplary embodiment of the hybrid antenna structure 1 according to the invention, with only the differences relative to the first exemplary embodiment of FIGS. 1, 2A, and 2B described, and, for the rest, reference is made to the statements made there.

According to this embodiment, a laminated pane 20 is provided with a carrier 4 embedded in the adhesive layer 21 and a transparent, conductive coating 6 applied on the second carrier surface 23. The conductive coating 6 is applied on the entire surface of the second carrier surface 23, without implementing a segmented edge region 15; but with its provision equally possible.

The coupling electrode 10 abuts the conductive coating 6 and is galvanically coupled therewith, but with provision of a capacitive coupling equally possible. The coupling electrode 10 extends past the upper, long edge of the pane 5*a* to the fourth pane surface 27 (side IV) of the inner pane 3. The linear antenna conductor 12 is applied, analogously to the third variant of the first exemplary embodiment described in conjunction with FIGS. 5A and 5B, as a conductor path 35 on the fourth pane surface 27 of the inner pane 3. At its other end, the coupling electrode 10 abuts the antenna conductor 12 and is galvanically coupled therewith, but with provision of a capacitive coupling equally possible. The antenna conductor 12 is situated outside the area 30, in which every point can be imaged by orthogonal parallel projection onto the planar antenna such that the linear antenna is not electrically loaded by the planar antenna. The connector conductor 19 makes contact with the antenna conductor 12 and leads directly away from the laminated pane 20.

Figure 9:
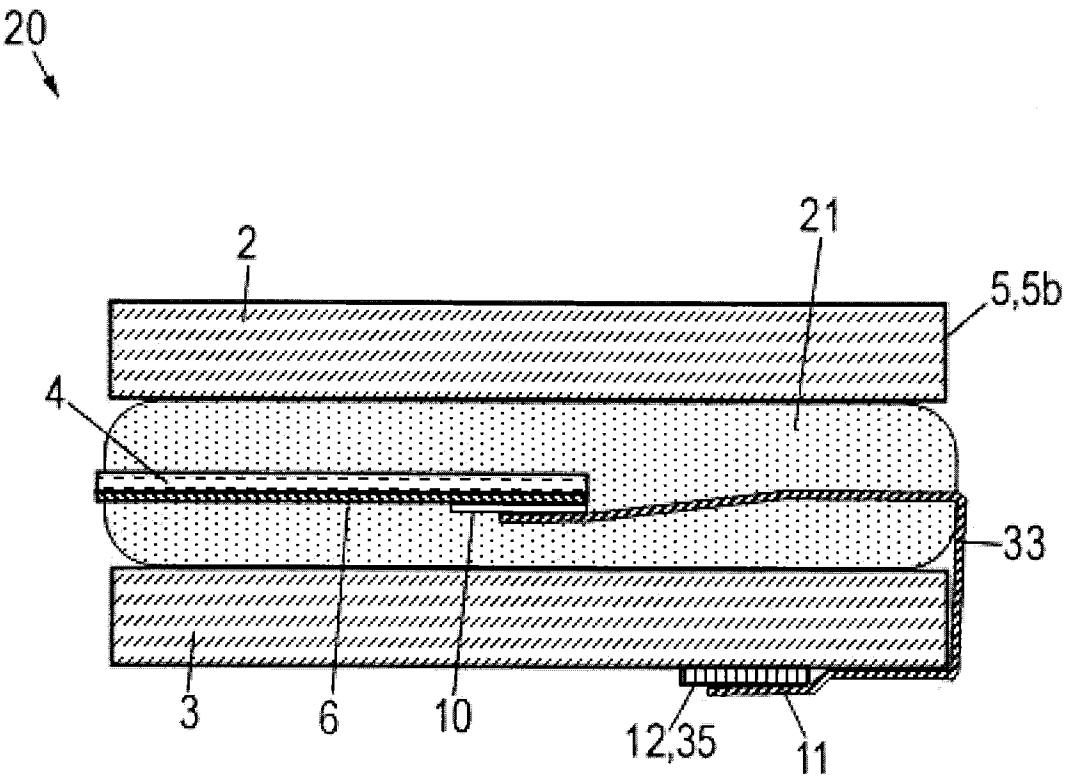
FIG. 9 a cross-sectional view of a variant of the hybrid antenna structure of FIG. 7 along section line A-A.

FIG. 9 depicts a variant with, to avoid repetitions, only the differences relative to the second exemplary embodiment of FIGS. 7, 8A, and 8B explained. According to this variant, the coupling electrode 10 is implemented only in the region of the conductive coating 6, abuts it in direct contact, and is thus galvanically coupled to the conductive coating 6, with the provision of a capacitive coupling equally possible. A first connection conductor 33 abuts, at one of its ends, the coupling electrode 10 in direct contact and is galvanically coupled to the conductive coating 6, but with the provision of a capacitive coupling equally possible. The first connection conductor 33 extends past the upper long edge of the pane 5*a* to the fourth pane surface 27 (side IV) of the inner pane 3 and makes contact, at its other end, with the antenna conductor 12 implemented as a conductor path. The first connection conductor 33 abuts the antenna conductor 12 in direct contact and is galvanically coupled therewith, for example, by a solder contact, but with the provision of a capacitive coupling equally possible. The first connection conductor 33 can be manufactured, for example, from the same material as the coupling electrode 10 such that the coupling electrode 10 and the first connection conductor 33 can be considered together as a two-part coupling electrode. The width (dimension perpendicular to the extension direction) of the first connection conductor 33 configured as a strip-shaped flat conductor preferably tapers toward the long edge of the pane 5*a* such that a capacitive coupling between the conductive coating 6 and and the motor vehicle body can be prevented.

The invention makes available a hybrid antenna structure that enables bandwidth optimized reception of electromagnetic waves, wherein, through the planar and linear antenna combination, satisfactory reception performance can be achieved over the complete frequency range of bands I-V.

LIST OF REFERENCE CHARACTERS

1 antenna structure
2 outer pane
3 inner pane
4 carrier
5 edge of the pane
5*a* long edge of the pane
5*b* short edge of the pane
6 coating
7 edge strip
8, 8' coating edge
9 masking strip
10 coupling electrode
11 first connector contact
12 antenna conductor
13 antenna foot point
14 second connector contact
15 edge region
16 segment
17 insulating region

18 wire
19 connector conductor
20 laminated pane
21 adhesive layer
22 first carrier surface
23 second carrier surface
24 first pane surface
25 second pane surface
26 third pane surface
27 fourth pane surface
28 edge zone
29 carrier edge
30 area
31 connector
32 bounding surface
33 first connection conductor
34 second connection conductor
35 conductor path

The invention claimed is:

1. A hybrid antenna structure, comprising:

an electrically insulating-substrate;

an electrically conductive coating, which covers a surface of the substrate and serves at least partially as a planar antenna for reception of electromagnetic waves; and a coupling electrode, which is electrically coupled to the conductive coating for coupling out of antenna signals from the planar antenna, wherein the coupling electrode is electrically coupled to an unshielded, linear antenna conductor, which serves as a linear antenna for reception of electromagnetic waves, wherein the linear antenna conductor is situated outside an area projected by orthogonal parallel projection onto the planar antenna serving as a projection area, such that an antenna foot point of the linear antenna becomes a common antenna foot point of the linear and planar antenna, wherein the conductive coating comprises an edge region, the edge region comprising a plurality of planar segments of the conductive coating that are subdivided by linear electrically insulating regions.

2. The hybrid antenna structure according to claim 1, characterized in that the coupling electrode is electrically coupled to the conductive coating such that the reception performance of the planar antenna is maximized.

3. The hybrid antenna structure of claim 1, wherein the common antenna foot point is electrically conductively connected via a connector conductor to an electronic signal processing device for the processing of received antenna signals, wherein the common antenna foot point is disposed such that the length of the connector conductor is as short as possible.

4. The hybrid antenna structure of claim 1, wherein the conductive coating covers the surface of the substrate except for a circumferential, electrically insulating edge strip, wherein the linear antenna conductor is applied on the substrate.

5. The hybrid antenna structure of claim 1, wherein the conductive coating is situated on a surface of a first substrate of a laminated pane formed from two first substrates bonded to each other and/or wherein the conductive coating is situated on a surface of a second substrate disposed between the two first substrates and serving as a carrier.

6. The hybrid antenna structure of claim 1, wherein the conductive coating is situated on one surface of the substrate and the linear antenna conductor is situated on a different surface therefrom of the same or of a different substrate therefrom.

7. The hybrid antenna structure of claim 1, wherein the coupling electrode and the linear antenna conductor are electrically conductively connected to each other via a first connection conductor.

8. The hybrid antenna structure of claim 7, wherein the linear antenna conductor is situated on one surface of the substrate and the common antenna foot point is situated on a different surface therefrom of the same or of a different substrate therefrom, wherein the linear antenna conductor and the common antenna foot point are electrically conductively connected to each other via a second connection conductor.

9. The hybrid antenna structure of claim 1, wherein the linear antenna conductor is printed in the form of a conductor path comprising a metallic printing paste onto the substrate, or is laid in the form of a wire.

10. The hybrid antenna structure of claim 8, wherein at least one conductor selected from the group consisting of the coupling electrode, the first connection conductor, and the second connection conductor, leads to an edge of the substrate and is implemented as a strip-shaped flat conductor with a tapering width in the region of the edge.

11. A method for producing a hybrid antenna structure of claim 1, the method comprising:

covering a section of a surface of an electrically insulating substrate with an electrically conductive coating, which serves at least section-wise as a planar antenna for reception of electromagnetic waves;

forming an unshielded, linear antenna conductor, which serves as a linear antenna for reception of electromagnetic waves, wherein the linear antenna conductor is situated outside an area projected by orthogonal parallel projection onto the planar antenna serving as a projection area; and producing a coupling electrode, which is electrically coupled to the conductive coating and to the linear antenna conductor.

12. The method of claim 11, wherein the linear antenna conductor is printed in the form of a conductor path with a metallic printing paste onto the substrate, or is laid in the form of a wire.

13. A functional and/or decorative piece, comprising the hybrid antenna structure of claim 1.

14. The hybrid antenna structure of claim 1, wherein the substrate is transparent.

15. The hybrid antenna structure of claim 1, wherein the electrically conductive coating is transparent.

16. The hybrid antenna structure of claim 1, wherein the linear antenna conductor is applied on the substrate in the region of the edge strip.

17. A furniture device, building, or vehicle, comprising the hybrid antenna structure of claim 1.

* * * * *